United States Patent [19]

Balmforth

[11] 3,964,747

[45] June 22, 1976

[54] GAME APPARATUS

[76] Inventor: Ernest Lynn Balmforth, 515 E. 3400 North, Provo, Utah 84601

[22] Filed: Feb. 10, 1975

[21] Appl. No.: 548,568

[52] U.S. Cl. ..... 273/131 AB; 273/137 R
[51] Int. Cl.[2] ..... A63F 3/02
[58] Field of Search ..... 273/131, 137

[56] References Cited

UNITED STATES PATENTS

| | | | |
|---|---|---|---|
| 1,628,412 | 5/1927 | Lesavoy | 273/137 R |
| 3,677,550 | 7/1972 | Mathers | 273/137 R |
| 3,920,247 | 11/1975 | Jenkins | 273/131 AB |

FOREIGN PATENTS OR APPLICATIONS

| | | | |
|---|---|---|---|
| 141,915 | 3/1931 | Switzerland | 273/131 K |
| 616,572 | 1/1949 | United Kingdom | 273/131 AB |

OTHER PUBLICATIONS

The Rules of Hex, by A. S. Braden; received Jan. 3, 1974, pp. 1–32 cited.

*Primary Examiner*—Delbert B. Lowe
*Attorney, Agent, or Firm*—Criddle, Thorpe & Western

[57] ABSTRACT

A game including a board with an hexagonal playing area having a plurality of contiguous, uniformly distributed hexagonal playing spaces thereon and adapted for use by either two or three players using two or three sets of playing pieces respectively. The periphery of the board playing area has six equal length sides each composed of seven playing spaces. Indicia on the playing area divides the outer row of playing spaces from the remaining interior playing spaces, with the interior spaces being used when two players play the game and with all spaces being used when three players play the game. The playing spaces are each one of three colors with no two adjacent spaces being of the same color. The sets of playing pieces are also differently colored and different playing pieces of subsets of a set are formed to include common features which define the way in which the playing pieces in a subset may be moved.

7 Claims, 11 Drawing Figures

GAME APPARATUS

BACKGROUND OF THE INVENTION

This invention relates to game apparatus which has some similarities to chess but which provides for a greater variety of moves of the playing pieces on a playing area composed of a plurality of hexagonal playing spaces.

A variety of games have been devised which, although different from the standard two-player chess game, are based generally on the same ideas embodied in standard chess. For example, chess-type games using a playing board having hexagonal playing spaces thereon have been suggested for both two players (U.S. Pat. No. 3,724,856 and British Patent No. 616,572) and three players (U.S. Pat. Nos. 3,744,797 and 3,778,065). Such games typically offer greater versatility in the types of moves which may be made with the playing pieces and therefore offer greater challenge to the players, but each such game is designed for only two players or is designed for only three players. A chess-type game in which either two, three or four players may participate has also been suggested, see U.S. Pat. No. 3,843,130, but in this game the standard square playing spaces are utilized and the types of moves of the playing pieces are therefore generally limited to those possible in standard chess.

Other games using a game board having hexagonal playing spaces, but having rules for playing which differ substantially from the standard chess game are disclosed in U.S. Pat. Nos. 485,029; 521,737; 526,373 and 1,704,819.

SUMMARY OF THE INVENTION

It is an object of the present invention to provide a game which is adapted for playing by either two or three players and in which the playing pieces generally have greater versatility of movement than in standard chess.

It is another object of the invention, in accordance with one aspect thereof, to provide a game having at least two sets of playing pieces in which different pieces in each subset of a set employ common indicia to indicate the manner in which such pieces in the subset may be moved to thereby simplify remembering the various moves of the playing pieces.

It is still another object of the present invention, in accordance with another aspect thereof, to provide a game having a playing area which is hexagonal in shape and includes a plurality of hexagonal playing spaces thereon, and in which two of such playing spaces located at opposite corners of the hexagonal area have indicia to distinguish the two spaces from the other spaces.

It is a further object of the present invention, in accordance with still another aspect thereof, to provide a game having a hexagonal playing area with a plurality of hexagonal playing spaces thereon, such game being adapted for playing by either two players, in which each player has a set of playing pieces initially positioned on the playing area to face each other, or three players, in which each of three sets of playing pieces is positioned on the board to face a location not occupied by any of the other sets.

The above and other objects of the present invention are realized in a specific illustrative embodiment of a game which includes a board with a hexagonal playing area having a plurality of contiguous, uniformly distributed, hexagonal playing spaces. The periphery of the board playing area has six equal length sides each composed of a predetermined number of playing spaces. Each playing space includes one of three indicia such that no two adjacent spaces have the same indicia. In accordance with one aspect of the invention, the game board includes markings to distinguish the peripheral row of playing spaces from the remaining interior playing spaces so that two players may play the game using two sets of playing pieces by positioning the pieces on the playing spaces interior to the outer row and so that three players may play the game with three sets of playing pieces by positioning the pieces on the playing area including the outer row. In accordance with another aspect of the invention, different playing pieces of a subset of each set of pieces have common indicia to identify the manner in which such pieces may be moved on the playing area. In accordance with still another aspect of the invention, two playing spaces located at opposite corners of the hexagon formed by the spaces which are interior to the outer row include indicia to distinguish the two spaces from the rest of the playing spaces. When two players play the game, each of the two sets of playing pieces is positioned on the playing area centered about, but not occupying, a different one of the two mentioned playing spaces.

BRIEF DESCRIPTION OF THE DRAWINGS

The above and other objects, features and advantages of the present invention will become apparent from a consideration of the following detailed description presented in connection with the accompanying drawings in which.

DETAILED DESCRIPTION

Figure 1:
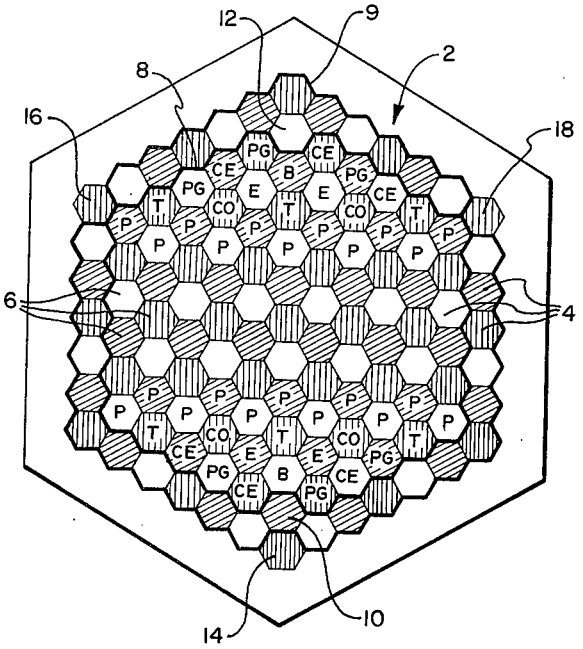
FIG. 1 is a plan view of a game board made in accordance with the present invention schematically showing two sets of playing pieces positioned for start of play by two players.

Referring to FIG. 1, there is shown one illustrative embodiment of a game board of the present invention. The game board includes a hexagonal playing area 2 having a plurality of contiguous, uniformly distributed hexagonal playing spaces 4. The preferred embodiment of FIG. 1 includes a total of 127 playing spaces, each of which is one of three colors with no two adjacent spaces being of the same color. Thus, as is evident from FIG. 1, each grouping of three contiguous hexagonal spaces such as grouping 6 includes one space of each of the three colors.

The periphery of the game board playing area has six equal length sides, each side having seven hexagonal playing spaces. The outer row of playing spaces, 36 in number, is divided or distinguished from the playing spaces interior thereto. Any type of indicia may be used to distinguish the outer row of spaces from the interior spaces, but the use of a prominent line 8 extending between the outer row and the interior spaces has been found especially suitable. As will be discussed more fully later, only the playing spaces interior to the line 8 (with the exception of spaces 10 and 12) are used when two players play the game, whereas all playing spaces are used when three players play the game.

Two playing spaces 10 and 12 located at opposite corners of the playing area interior to the outer row of spaces include indicia to distinguish the two spaces from the rest of the playing spaces. The indicia in this case is line 8 which separates the two spaces 10 and 12 from the spaces interior to line 8. Similarly, playing spaces 14, 16 and 18 located at alternate corners of the outer row of spaces include indicia for distinguishing the three spaces from the remaining playing spaces. Specifically, line 9 separates the three spaces from the other playing spaces. These five playing spaces are denoted "Palace Positions" and are provided for purposes to hereafter be described.

Figure 11:
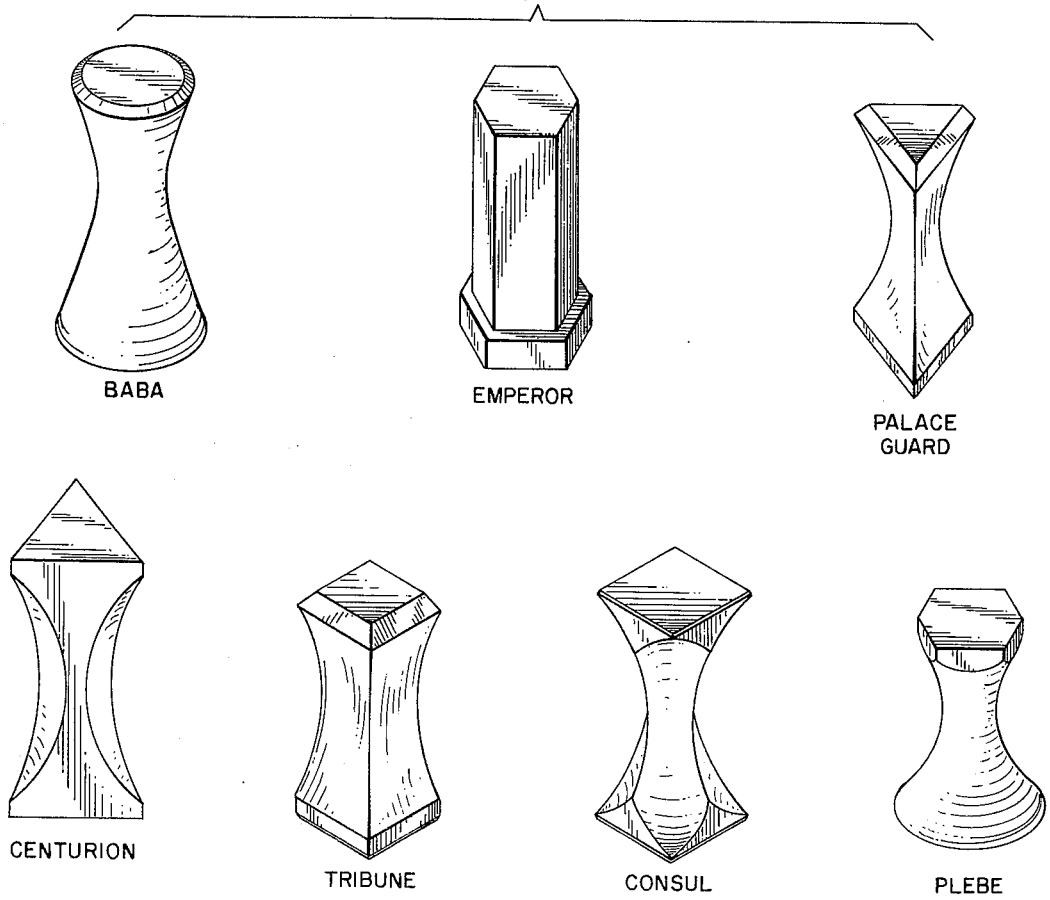
FIG. 11 is a perspective view of each type of playing piece used in the present invention.

With the game board structure described above, either two or three players may play the game. Each player utilizes a set of twenty-five playing pieces, with each set having seven different type pieces. These seven different type pieces are shown in FIG. 11 and include the following:

Baba — B
Emperor — E
Palace Guard — PG
Centurion — CE
Tribune — T
Consul — CO
Plebe — P As indicated in FIG. 1, each set of playing pieces includes one Baba, two Emperors, three Palace Guards, three Centurions, three Tribunes, two Consuls and 11 Plebes.

When two players play the game, two sets of playing pieces are used and the starting positions of such pieces are shown in FIG. 1. Both sets of playing pieces are positioned on spaces within the line 8 and centered about but not occupying a different one of the Palace Positions 10 and 12. Note that each of the two sets of playing pieces is positioned to face the other set. Movement of the playing pieces, when two players play the game, is confined to the playing spaces within the line 8 plus spaces 10 and 12.

Figure 2:
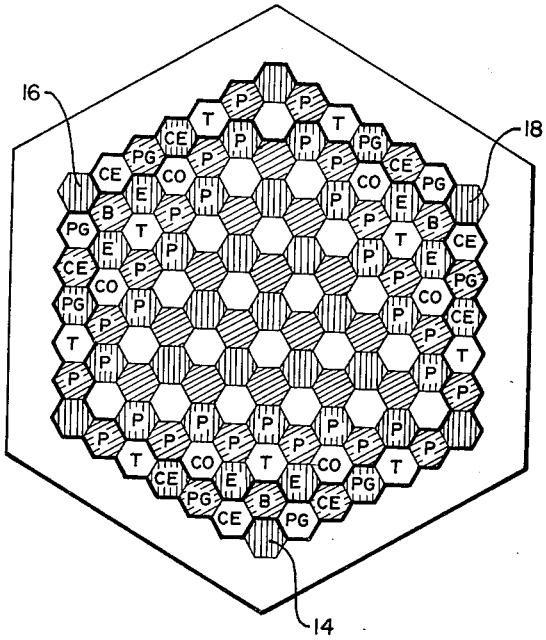
FIG. 2 is a plan view of the game board of FIG. 1 schematically showing three sets of playing pieces positioned for start of play by three players.

When three players play the game, three sets of playing pieces are used with the starting positions of such pieces being shown in FIG. 2. Each set of playing pieces in FIG. 2 is centered about a different one of the Palace Positions 14, 16 and 18 and faces an opposite corner of the playing area but not either of the other two sets of playing pieces. Movement of the pieces, when three players play the game, is over any of the 127 playing spaces. Permitted moves for each type of playing piece will now be described.

Figure 3:
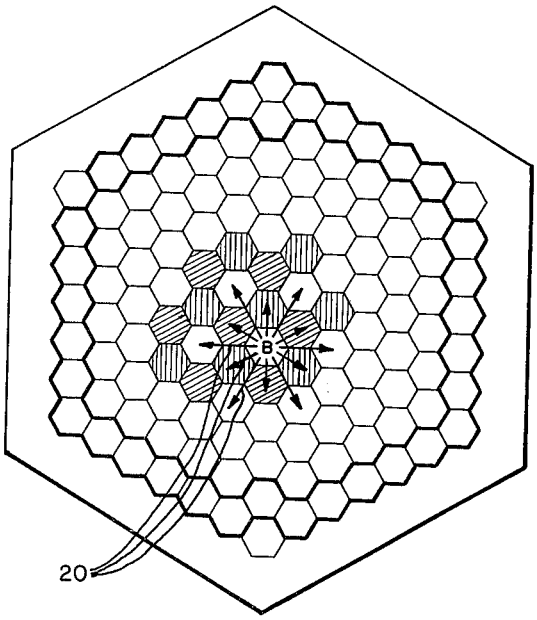
FIG. 3 is a view similar to that of FIG. 1 illustrating the movement of a Baba on the board.

As shown in FIG. 3, the Baba may move one space in any direction through either the sides or corners of a playing space as indicated by arrows 20. A Baba may capture an opponent's piece by displacing the piece from the board and occupying the space formerly held by the displaced piece.

Figure 4:
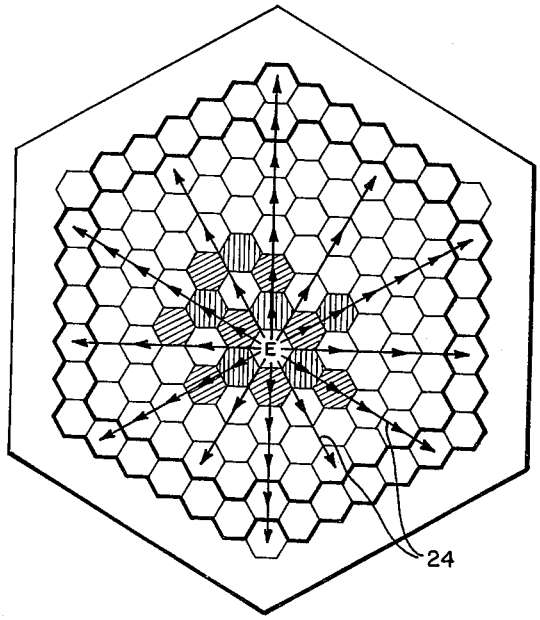
FIG. 4 is a view similar to that of FIG. 1 illustrating the movement of an Emperor on the board.

As shown in FIG. 4, an Emperor may be moved in a straight line through any one of the six corners or across any one of the six sides of a playing space over any number of unoccupied playing spaces (as indicated by arrows 24) either to another unoccupied playing space or to displace an opponent's playing piece.

Figure 5:
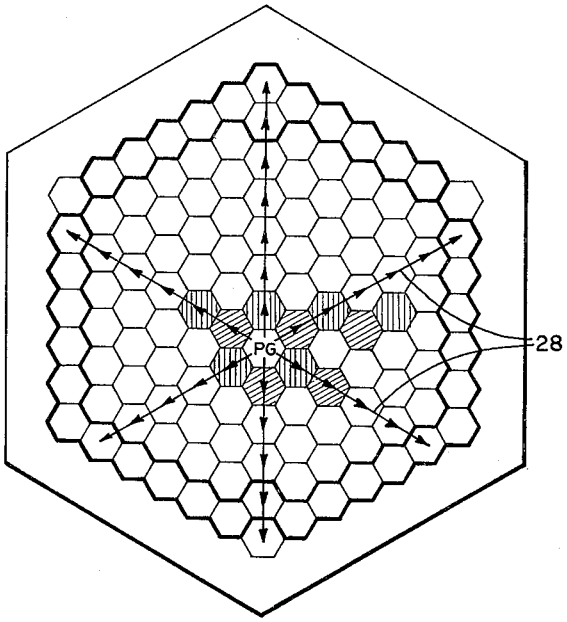
FIG. 5 is a view similar to that of FIG. 1 illustrating the movement of a Palace Guard on the board.

As seen in FIG. 5, a Palace Guard may be moved in a straight line across any one of the six sides of a playing space over any number of unoccupied playing spaces (as indicated by arrows 28) either to another unoccupied playing space or to displace an opponent's piece.

Figure 6:
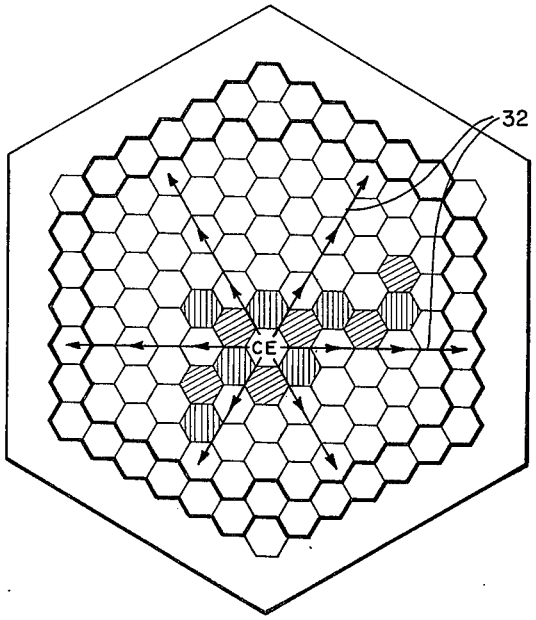
FIG. 6 is a view similar to that of FIG. 1 illustrating the movement of a Centurion on the board.

FIG. 6 illustrates the manner in which a Centurion may be moved. In particular, a Centurion may move through any one of the six corners of a playing space in a straight line over any number of unoccupied playing spaces (as indicated by arrows 32) to another unoccupied playing space or to displace an opponent's playing piece.

Figure 7:
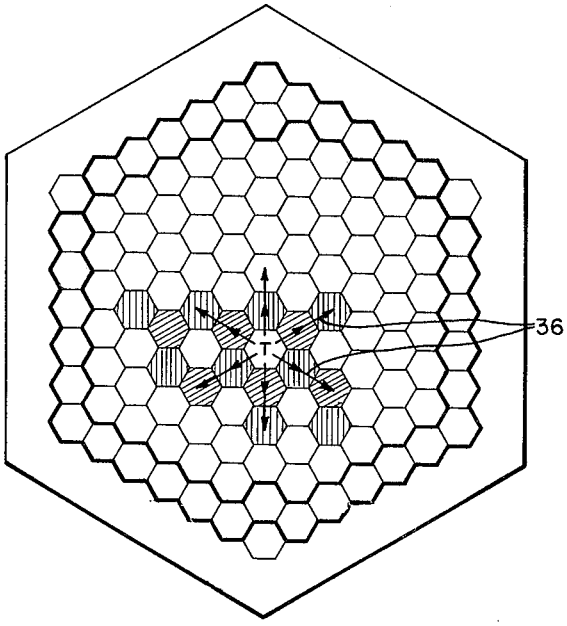
FIG. 7 is a view similar to that of FIG. 1 illustrating the movement of a Tribune on the board.

As shown in FIG. 7, a Tribune may be moved across any one of the six sides of a playing space in a straight line either one or two playing spaces only (as indicated by arrows 36). A Tribune may also jump one of its own playing pieces to arrive at the second playing space. A first move alternative for the Tribune will be discussed later.

Figure 8:
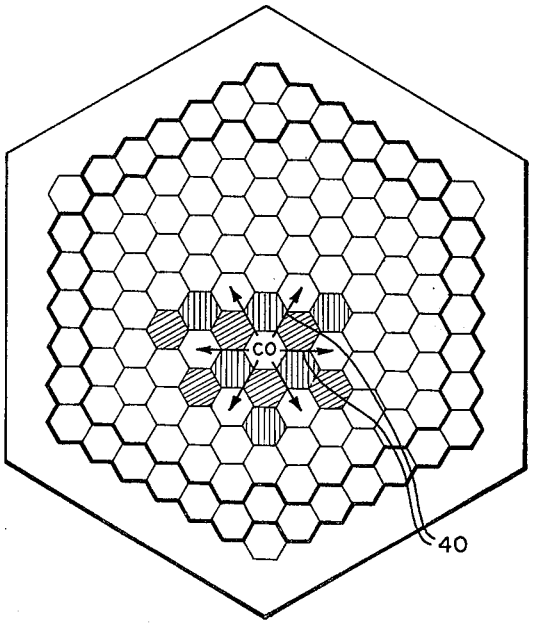
FIG. 8 is a view similar to that of FIG. 1 illustrating the movement of a Consul on the board.

FIG. 8 shows the manner in which a Consul may be moved, this being through any one of the six corners of a playing space one playing space away (as indicated by arrows 40).

Figure 9:
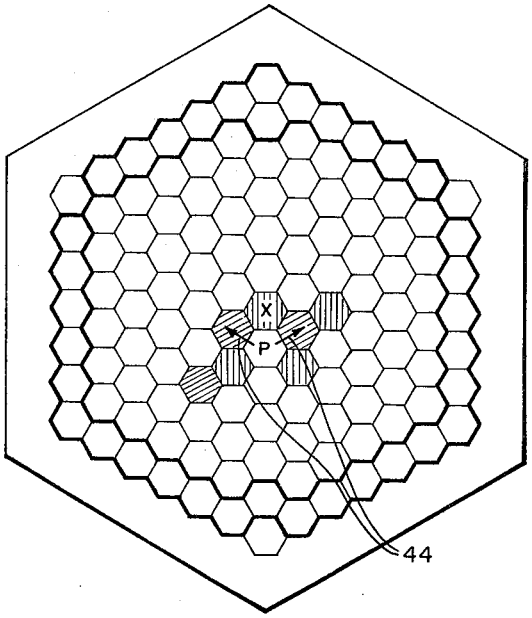
FIG. 9 is a view similar to that of FIG. 1 illustrating the movement of a Plebe on the board.

A Plebe may be moved only one playing space in a slanted forward direction across one of two sides of a playing space as indicated by arrows 44 in FIG. 9. A Plebe may move directly forward across the side of a playing space only when displacing an opponent's playing piece.

Figure 10:
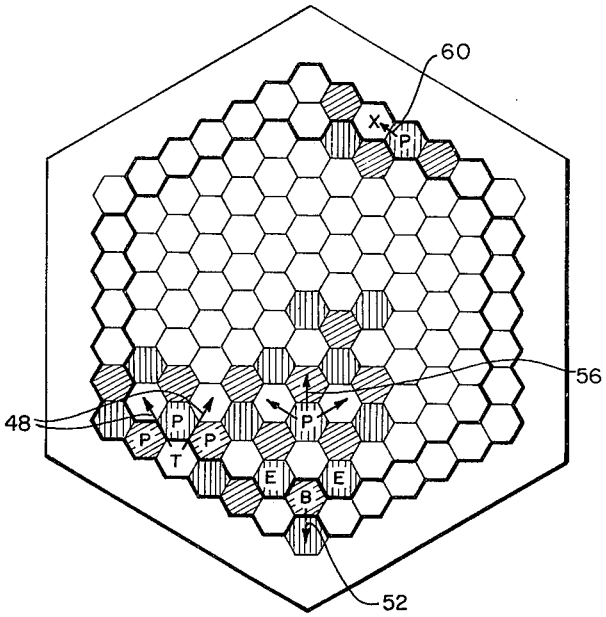
FIG. 10 is a view similar to that of FIG. 1 showing the alternate first moves which may be made by a Tribune and by a Plebe.

In FIG. 10, there are shown alternative first moves for a Tribune, Baba and Plebe. For a Tribune, if all three Plebes directly fronting a Tribune have not been moved from their starting positions, then the Tribune may be moved across one of the two forward corners to an outside playing space (as indicated by arrows 48 of FIG. 10). Once a Tribune is so moved, it thereafter assumes its normal moving powers for the remainder of the game. If any one of the three Plebes directly fronting a Tribune has been moved, then the Tribune is permitted to move only according to its normal moving powers.

When neither Emperor has been moved from its starting position, the Baba may be moved from its starting position across the rear side of the initial playing space into the Palace Position (as indicated by arrow 52 of FIG. 10). Once occupied by the Baba the Palace Position may thereafter be used by any playing piece. If the Baba is not moved to the Palace Position prior to movement of one of the Emperors, the Palace Position may not be used for the remainder of the game by any playing piece.

When being moved from its starting position, a Plebe may be moved directly forward across the forward side of the initial playing space (as indicated by arrow 56) as well as being moved in the slanted forward direction.

After its first move, a Plebe may then move in the forward direction only when capturing an opponent's playing piece, otherwise the Plebe is limited to moving in the slanted forward direction as previously described.

If a Plebe reaches the Palace Position of an opposing player, the Plebe may be exchanged for an Emperor. If a Plebe reaches an opponent's outside row of playing spaces, it may move in a slanted direction toward the Palace Position to capture or displace an opponent's playing piece (as indicated by arrow 60 of FIG. 10).

As with regular chess, the players, whether two or three in number, move alternately. The player to move first and the sequence in which the players are to move may be decided by the players. Of course, two playing pieces never occupy the same playing space at the same time. As previously indicated, displacement of an opponent's playing piece is made by occupying the playing space occupied by the opponent's piece to be removed.

When three players play the game, prior to the start of the game the player who is to move first makes an election as to the disposition of the playing pieces of whatever player will eventually be the first eliminated from the game (to be described momentarily). This election may be that such playing pieces are to be "destroyed" (removed from the board) or "inherited" (adopted and used by the player who causes the elimination).

A player is eliminated from the game when his Baba is put in a position to be displaced by an opponent's playing piece. When this condition exists, it is referred to as "covering" and the Baba in question is referred to as being placed in "quan" (to be on one's guard). The player whose Baba is placed in quan must be warned by the player covering. To escape from being in quan a player must either: (1) move his Baba out of danger; (2) displace the attacking piece; or (3) put another playing piece between the attacking opponent's piece and his Baba. If none of these alternatives is possible, then the player whose Baba is in quan is eliminated from the game and, in the case of three players, his playing pieces are either removed from the board or are adopted and used by the player covering, depending upon the election made at the start of the game.

FIG. 11 shows the different playing pieces used in the present invention. The different pieces have been shaped and contoured to aid players in remembering the manner in which the different pieces may be moved on the game board. In particular, those playing pieces having triangular shapes (the Palace Guard and Centurion) may be moved an unlimited number of playing spaces in a straight line. Those playing pieces which are square shaped (the Tribune and Consul) are limited in the number of playing spaces over which they may be moved. The triangular and square playing pieces which are beveled on the top (Palace Guard and Tribune) may move across playing space sides only whereas the triangular and square pieces not beveled on the top (Centurion and Consul) move through the corners of a playing space only. Of course any indicia could be used to designate how different subgroups of a set of playing pieces could be moved but providing different shapes for such indicia has been found especially advantageous. Note that the Baba, Emperor and Plebe do not fall into any of the identified subgroups of playing pieces for which the special indicia is provided.

It is to be understood that the above-described arrangement is only illustrative of the application of the principles of the present invention. Numerous other modifications and alternative arrangements may be devised by those skilled in the art without departing from the spirit and scope of the present invention and the appended claims are intended to cover such modifications and arrangements.

What is claimed is:

1. A game for two or three players comprising a game board including a hexagonal playing area having a plurality of contiguous, uniformly distributed hexagonal playing spaces thereon, each of the six sides of the playing area composed of a fixed number of playing spaces to form an outer row of spaces, each playing space including one of three indicia such that no two adjacent spaces have the same indicia, said game board further including markings to distinguish the outer row of playing spaces from the remaining playing spaces interior thereto, three sets of playing pieces, each including indicia corresponding to a different one of said three indicia, whereby two of the sets of playing pieces are positioned on and moved among the said interior playing spaces when two players use the apparatus, and the three sets of playing pieces are positioned on and moved among all the playing spaces when three players use the apparatus, and wherein each set of playing pieces includes a plurality of subsets, each of which includes a number of different playing pieces having different moving capabilities, said different playing pieces of a subset having a common feature identifying common type moves on the playing area of the board which may be made with such pieces.

2. A game for two or three players comprising a game board including a hexagonal playing area having a plurality of contiguous, uniformly distributed hexagonal playing spaces thereon, each of the six sides of the playing area composed of a fixed number of playing spaces to form an outer row of spaces, each playing space including one of three indicia such that no two adjacent spaces have the same indicia, said game board further including markings to distinguish the outer row of playing spaces from the remaining playing spaces interior thereto, three sets of playing pieces, each including indicia corresponding to a different one of said three indicia, whereby two of the sets of playing pieces are positioned on and moved among the said interior playing spaces when two players use the apparatus, and the three sets of playing pieces are positioned on and moved among all the playing spaces when three players use the apparatus, and wherein three playing spaces located at alternate corners of the game board playing area include indicia for distinguishing the three spaces from the other playing spaces, and wherein two playing spaces located at opposite corners of the game board area occupied by said interior playing spaces include indicia for distinguishing the two spaces from the other spaces.

3. A game comprising a game board including a hexagonal playing area having ninety-one contiguous, uniformly distributed hexagonal playing spaces thereon, each of the six sides of the playing area comprising a row of six playing spaces, each playing space including one of three indicia such that no two adjacent spaces have the same indicia, two playing spaces located at opposite corners of the game board area including indicia to distinguish the two spaces from all the other 89 playing spaces, and two sets of playing pieces for use by two players, each set having indicia to distinguish its pieces from the pieces of the other set and each set being initially disposed on said playing area so as to be centered about, but not occupying, a different one of said two playing spaces.

4. A game as in claim 3 wherein said game board further includes an outer row of thirty-six hexagonal playing spaces which are contiguous with and circumscribe the other 91 playing spaces, and markings to distinguish the outer row of playing spaces from the other 91 spaces, wherein three playing spaces located at alternate corners of the outer row include indicia for distinguishing the three spaces from all the other playing spaces, and wherein said game further comprises a third set of playing pieces having indicia to distinguish the pieces of the third set from the pieces of the other two sets, said third set being provided for use by a third player so that when three players participate, each of the three playing piece sets are initially disposed on the playing area including said outer row so as to be centered about, but not occupying, a different one of said three playing spaces.

5. A game as in claim 4 wherein each set of playing pieces includes 25 pieces.

6. A game as in claim 3 wherein different playing pieces of a subset of a set include a common indicia which identifies the moves on the playing area of the board which may be made with such pieces.

7. A game comprising a game board including a hexagonal playing area having 91 contiguous, uniformly distributed hexagonal playing spaces thereon, each of the six sides of the playing area composed of a row of playing spaces of a predetermined number, each playing space including one of three indicia such that no two adjacent spaces have the same indicia, and two sets of playing pieces for use by two players, each set including indicia to distinguish its pieces from those of the other set, each set of playing pieces including a plurality of subsets, each of which includes a number of different playing pieces having different moving capabilities, said different playing pieces of a subset having a common feature identifying common type moves on the playing area of the board which may be made with such pieces.

* * * * *